US008541067B2

(12) United States Patent
Yilbas et al.

(10) Patent No.: US 8,541,067 B2
(45) Date of Patent: Sep. 24, 2013

(54) METHOD OF LASER TREATING TI-6AI-4V TO FORM SURFACE COMPOUNDS

(75) Inventors: Bekir Sami Yilbas, Dhahran (SA); Syed Sohail Akhtar, Dhahran (SA); Cihan Karatas, Ankara (TR); Abdul Aleem Bangalore Jabbar, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 394 days.

(21) Appl. No.: 12/898,434

(22) Filed: Oct. 5, 2010

(65) Prior Publication Data

US 2012/0082801 A1 Apr. 5, 2012

(51) Int. Cl.

| | |
|---|---|
| ***C08J 7/18*** | (2006.01) |
| ***C08J 3/28*** | (2006.01) |
| ***B05D 3/06*** | (2006.01) |
| ***C23C 4/10*** | (2006.01) |
| ***C23C 8/24*** | (2006.01) |
| ***C01B 31/12*** | (2006.01) |

(52) U.S. Cl.

USPC ..... 427/554; 427/190; 427/255.394; 427/410; 427/601; 264/29.1

(58) Field of Classification Search

USPC ..... 427/596, 597, 202, 203, 205, 419.1, 427/419.7, 554, 555, 582, 586, 228, 255.11, 427/255.21, 255.394; 428/698, 408

See application file for complete search history.

(56) References Cited

U.S. PATENT DOCUMENTS

| | | | | |
|---|---|---|---|---|
| 2,636,856 | A * | 4/1953 | Suggs et al. | 204/290.03 |
| 4,299,860 | A * | 11/1981 | Schaefer et al. | 427/556 |
| 4,304,978 | A | 12/1981 | Saunders | |
| 4,434,189 | A * | 2/1984 | Zaplatynsky | 427/556 |
| 4,588,450 | A * | 5/1986 | Purohit | 148/238 |
| 5,145,530 | A | 9/1992 | Cassady | |
| 5,290,368 | A | 3/1994 | Gavigan et al. | |
| 5,330,587 | A | 7/1994 | Gavigan et al. | |
| 5,368,939 | A * | 11/1994 | Kawamura et al. | 428/408 |

(Continued)

FOREIGN PATENT DOCUMENTS

JP 4041662 A 2/1992

OTHER PUBLICATIONS

"Laser gas-assisted processing of carbon coated and TiC embedded Ti-6AI-4V alloy surface", Yilbas et al., Applied Surface Science, Jul. 16, 2010.*

*Primary Examiner* — Michael Cleveland
*Assistant Examiner* — Eric Weedon
(74) *Attorney, Agent, or Firm* — Richard C. Litman

(57) ABSTRACT

The method of laser treating Ti-6Al-4V to form surface compounds is a method of forming barrier layers on surfaces of Ti-6Al-4V workpieces. The Ti-6Al-4V workpiece is first cleaned and then a water-soluble phenolic resin is applied to at least one surface of the Ti-6Al-4V workpiece. The Ti-6Al-4V workpiece and the layer(s) of water soluble phenolic resin are then heated to carbonize the phenolic resin, thus forming a carbon film on the at least one surface. TiC particles are then inserted into the carbon film. Following the insertion of the TiC particles, a laser beam is scanned over the at least one surface of the Ti-6Al-4V workpiece. A stream of nitrogen gas is sprayed on the surface of the Ti-6Al-4V workpiece coaxially and simultaneously with the laser beam at a relatively high pressure, thus forming a barrier layer of $TiC_xN_{1-x}$, $TiN_x$, Ti—C, and $Ti_2N$ compounds in the surface region.

19 Claims, 8 Drawing Sheets

(56) References Cited

U.S. PATENT DOCUMENTS

| | | | | |
|---|---|---|---|---|
| 5,411,770 | A | 5/1995 | Tsai et al. | |
| 5,413,641 | A * | 5/1995 | Coulon | 148/224 |
| 6,024,899 | A * | 2/2000 | Peng et al. | 264/29.1 |
| 6,231,956 | B1 * | 5/2001 | Brenner et al. | 428/216 |
| 6,630,768 | B2 | 10/2003 | Yamashiro et al. | |
| 2004/0265500 | A1 * | 12/2004 | Kucera et al. | 427/443.1 |
| 2006/0075850 | A1 | 4/2006 | Brice | |
| 2008/0233425 | A1 * | 9/2008 | Dekempeneer | 428/634 |
| 2010/0035051 | A1 | 2/2010 | Yilbas et al. | |

* cited by examiner

METHOD OF LASER TREATING TI-6AI-4V TO FORM SURFACE COMPOUNDS

BACKGROUND OF THE INVENTION

1. Field of the Invention

The present invention relates generally to surface hardening of metals, and particularly to a method of laser treating Ti-6Al-4V to form barrier surface compounds using gas-assisted laser nitriding.

2. Description of the Related Art

Titanium alloys are metallic materials which contain a mixture of titanium and other chemical elements. Such alloys have very high tensile strength and toughness (even at extreme temperatures), are light in weight, exhibit extraordinary corrosion resistance, and have the ability to withstand extreme temperatures. Although "commercially pure" titanium has acceptable mechanical properties and has been used for orthopedic and dental implants, for most applications titanium is alloyed with small amounts of aluminum and vanadium, typically 6% and 4%, respectively, by weight. This mixture has a solid solubility which varies dramatically with temperature, allowing it to undergo precipitation strengthening. This heat treatment process is carried out after the alloy has been worked into its final shape but before it is put to use, allowing much easier fabrication of a high-strength product.

The American Society for Testing and Materials (ASTM) classifies titanium alloys by numerical grades. "Grade 5", also known as Ti-6Al-4V, is the most commonly used alloy. It has a chemical composition of 6% aluminum, 4% vanadium, 0.25% (maximum) iron, 0.2% (maximum) oxygen, and the remainder titanium. Grade 5 is used extensively in the aerospace, medical, marine, and chemical processing industries. Ti-6Al-4V is significantly stronger than commercially pure titanium while having the same stiffness and thermal properties. Among its many advantages, it is heat treatable.

This grade also exhibits an excellent combination of strength, corrosion resistance, weld and fabricability. Generally, it is used in applications up to 400° C., and its properties are very similar to those of the 300 stainless steel series, particularly stainless steel 316.

Titanium dioxide dissolves in titanium alloys at high temperatures, and its formation is very energetic. These two factors mean that all titanium, except the most carefully purified, has a significant amount of dissolved oxygen, and so may be considered a Ti—O alloy. Oxide precipitates offer some strength, but are not very responsive to heat treatment and can substantially decrease the alloy's toughness. In order to protect a titanium alloy, the formation of surface barrier compounds is desirable. Thus, a method of laser treating Ti-6Al-4V to form surface compounds solving the aforementioned problems is desired.

SUMMARY OF THE INVENTION

The method of laser treating Ti-6Al-4V to form surface compounds is a method of forming barrier layers on surfaces of Ti-6Al-4V plates or workpieces. The Ti-6Al-4V workpiece is first cleaned, both with a chemical bath and then through an ultrasonic cleaning process. Any suitable type of chemical bath for cleaning titanium alloys may be used, as is conventionally known. Similarly, any suitable type of ultrasonic cleaning process may be used.

Following cleaning of the workpiece, a water-soluble phenolic resin is applied to at least one surface of the Ti-6Al-4V workpiece. The Ti-6Al-4V workpiece and the layer(s) of water soluble phenolic resin are then heated to carbonize the water soluble phenolic resin, thus forming a carbon film on the at least one surface. TiC particles are then inserted into the carbon film.

Following the insertion of the TiC particles, a laser beam is scanned over the Ti-6Al-4V workpiece. Preferably, the laser beam is produced by a carbon dioxide laser with a power intensity output of approximately 110 W/m$^2$. Scanning preferably occurs at a rate of approximately 10 cm/sec. A stream of nitrogen gas, which may be atomic or diatomic nitrogen formed by any suitable method (such as dissociation from ammonia at high temperature), is sprayed on the surface of the Ti-6Al-4V workpiece coaxially and simultaneously with the laser beam at a relatively high pressure, such as approximately 600 kPa, thus forming a barrier layer of $TiC_xN_{1-x}$, $TiN_x$, Ti—C, and $Ti_2N$ compounds in the surface region, typically at a depth of 15 μm in the laser-irradiated region.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The method of laser treating Ti-6Al-4V to form surface compounds is a method of forming barrier layers on surfaces of Ti-6Al-4V plates or workpieces. Such barrier nitride or carbonitride layers harden the surface, protect the available oxidizing metallic species of the titanium alloy, and further impede egress of surface dislocations, which tend to cause increases in fatigue and creep strengths.

Figure 1:
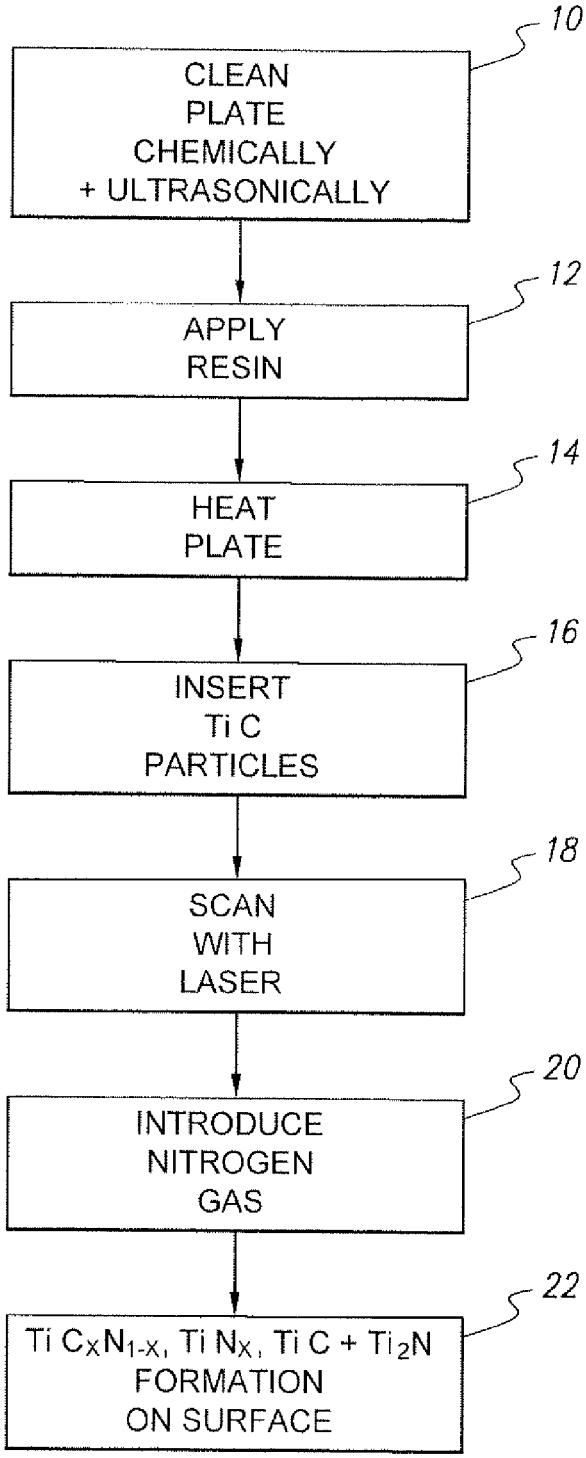
FIG. 1 is a flowchart showing the steps in a method of laser treating Ti-6Al-4V to form surface compounds according to the present invention.
Figure 2A:
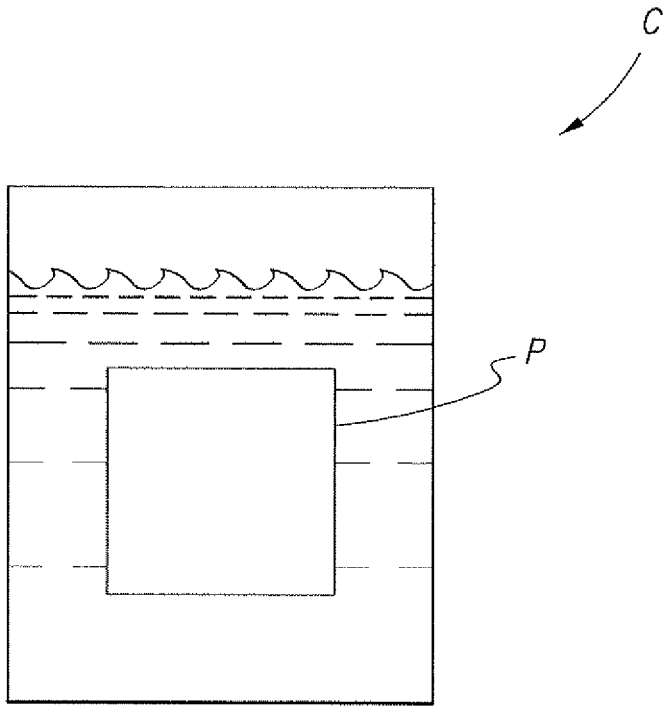
FIG. 2A is a diagrammatic front view of a first cleaning step in the method of laser treating Ti-6Al-4V to form surface compounds according to the present invention.

The Ti-6Al-4V workpiece or plate P is first cleaned, both with a chemical bath and then through an ultrasonic cleaning process (step 10 in FIG. 1). Any suitable type of chemical bath for cleaning Ti-6Al-4V alloy may be used, as is conventionally known. FIG. 2A diagrammatically illustrates a Ti-6Al-4V plate P being cleaned in a chemical bath C.

Figure 2B:
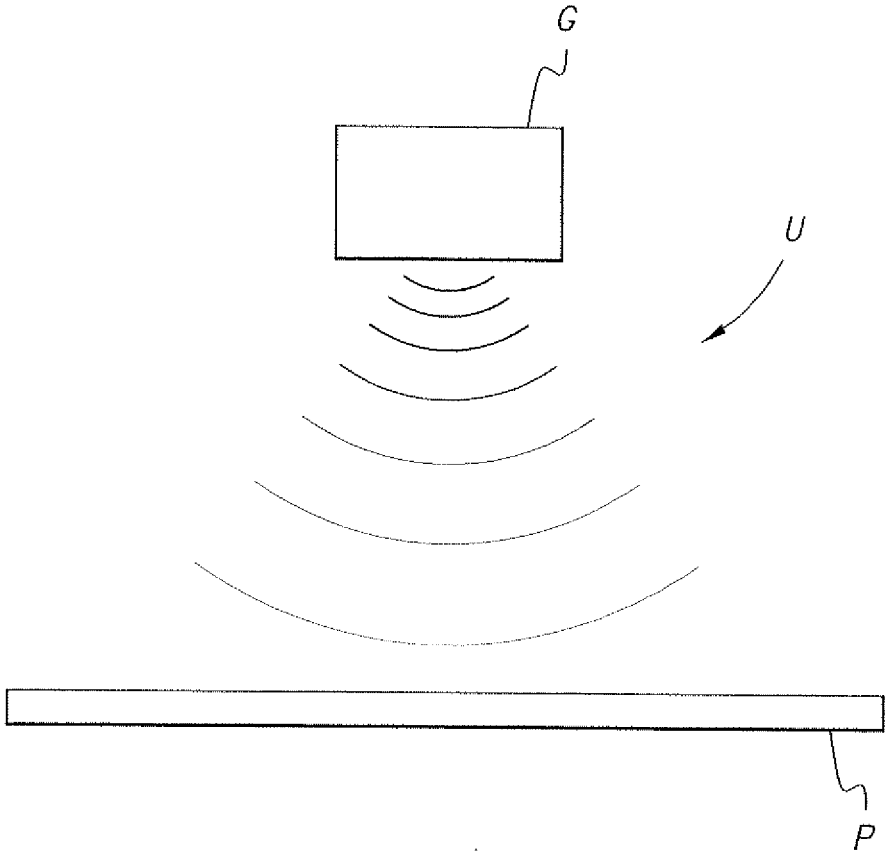
FIG. 2B is a diagrammatic front view of a second cleaning step in the method of laser treating Ti-6Al-4V to form surface compounds according to the present invention.

Similarly, any suitable type of ultrasonic cleaning process may be used. Ultrasonic cleaners are well known in the art. One example of such a cleaner is shown in U.S. Pat. No. 6,630,768, which is hereby incorporated by reference. FIG. 2B diagrammatically illustrates plate P undergoing ultrasonic cleaning through the impingement thereon by ultrasonic waves U generated by an ultrasonic generator or transducer G.

Figure 2C:
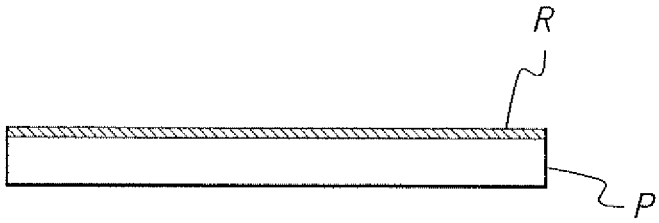
FIG. 2C is a diagrammatic side view in partial section of a third step in the method of laser treating Ti-6Al-4V to form surface compounds according to the present invention, illustrating application of a water soluble phenolic resin to a Ti-6Al-4V workpiece.
Figure 2D:
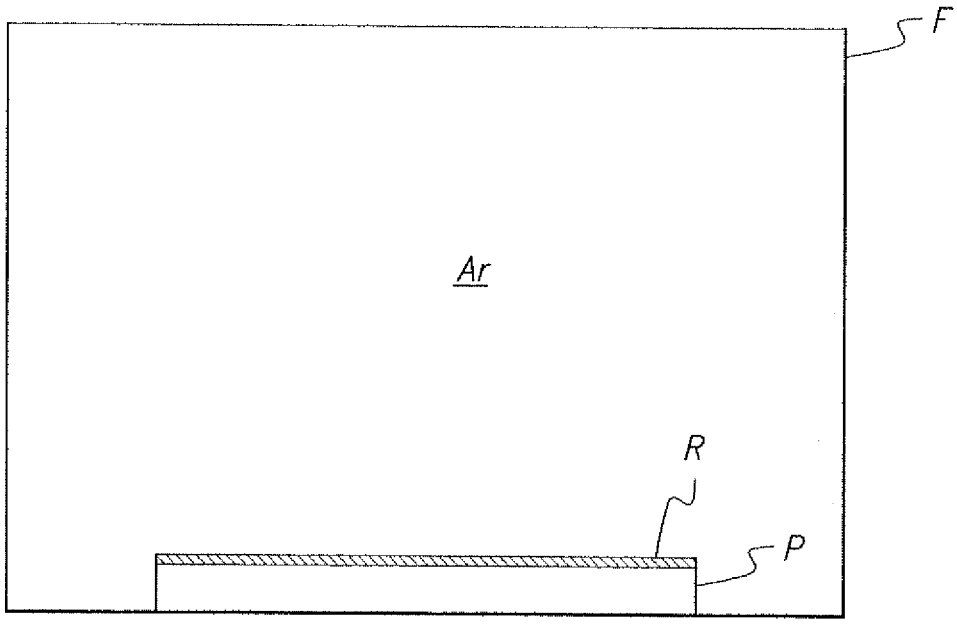
FIG. 2D is a diagrammatic side view in partial section of a fourth step in the method of laser treating Ti-6Al-4V to form surface compounds according to the present invention, illustrating heating of the Ti-6Al-4V workpiece to form a carbon film thereon.

As diagrammatically illustrated in FIG. 2C, following cleaning of the plate P, a water soluble phenolic resin R, such as thermoset vinyl-phenolic resin, is applied to at least one surface of the Ti-6Al-4V workpiece P (step 12). As illustrated in FIG. 2D, the Ti-6Al-4V workpiece and the layer(s) of water soluble phenolic resin are then heated to carbonize the water soluble phenolic resin, thus forming a carbon film CF on the at least one surface (step 14). In FIG. 2D, the Ti-6Al-4V workpiece P and the layer(s) of water-soluble phenolic resin R are shown being heated in a furnace F, preferably with an atmosphere of high-pressure argon (approximately 8 bars of pressure within furnace F during the heating) at a temperature of approximately 175° C. Once the density of the workpiece P had reached approximately 1.44 g/cm$^3$ (occurring at approximately two hours of heating), the carbonization process is stopped.

Figure 2E:
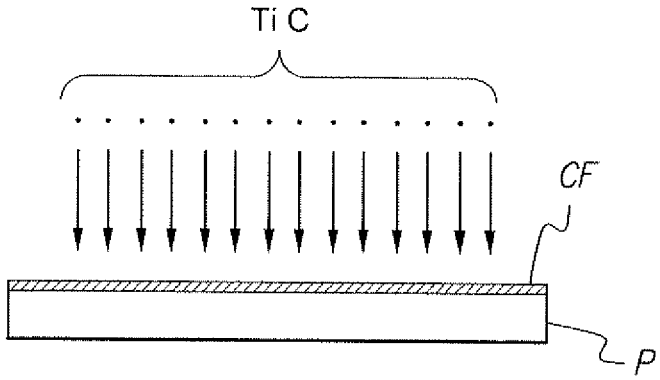
FIG. 2E is a diagrammatic side view in section of a fifth step in the method of laser treating Ti-6Al-4V to form surface compounds according to the present invention, illustrating insertion of TiC particles into the carbon film.

As illustrated in FIG. 2E, TiC particles are then inserted into the carbon film layer CF (step 16). The TiC particles may be inserted into carbon film CF by any suitable process. Preferably, the average size of the TiC particles is typically on the order of 6 μm, and the volume fraction of TiC particles inserted into the carbon film CF is approximately 20%.

Figure 2F:
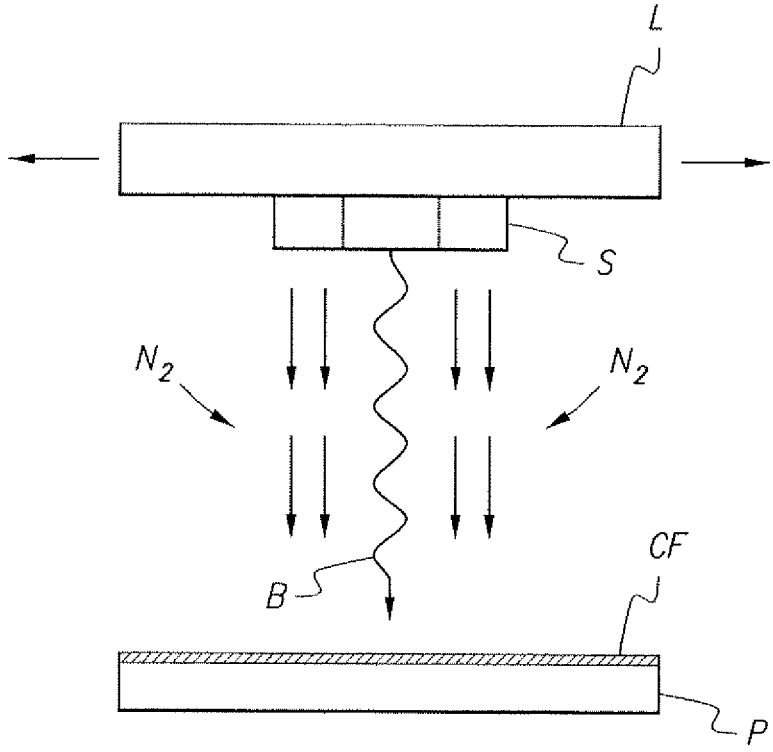
FIG. 2F is a diagrammatic side view in partial section of a gas-assisted laser nitriding step in the method of laser treating Ti-6Al-4V to form surface compounds according to the present invention.

As illustrated in FIG. 2F, following the insertion of the TiC particles, a laser beam B is scanned over the surface of the Ti-6Al-4V workpiece (step 18). Preferably, the laser beam B is produced by a carbon dioxide laser L with a power intensity output of approximately 110 W/m$^2$. It should be understood that any suitable type of laser may be utilized. Scanning preferably occurs at a rate of approximately 10 cm/sec. The laser may be scanned and applied to the surface of the plate P by any suitable method of laser treatment. Such nitriding lasers and laser scanning systems are well known in the art. One such example is shown in U.S. Pat. No. 5,411,770, which is hereby incorporated by reference in its entirety.

A stream of nitrogen gas, which may be atomic or diatomic nitrogen formed by any suitable method (such as dissociation from ammonia at high temperature) is sprayed on the surface of the Ti-6Al-4V workpiece P coaxially and simultaneously with the laser beam B at a relatively high pressure, such as a pressure of approximately 600 kPa (step 20 in FIG. 1), thus forming a barrier layer of $TiC_xN_{1-x}$, $TiN_x$, Ti—C, and $Ti_2N$ compounds in the surface region (step 22), typically at a depth of 15 μm in the laser-irradiated region.

Figure 3A:
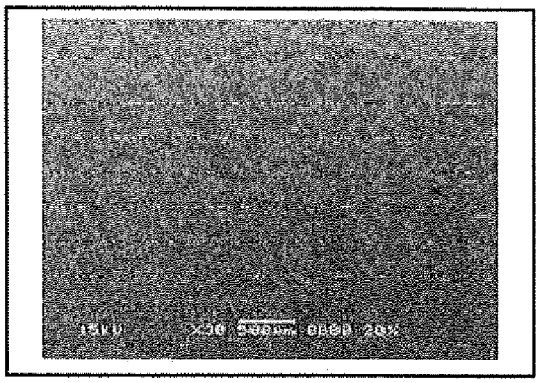
FIG. 3A is a scanning electron microscope micrograph image of a laser-treated Ti-6Al-4V surface produced by the method of laser treating Ti-6Al-4V to form surface compounds according to the present invention.
Figure 3B:
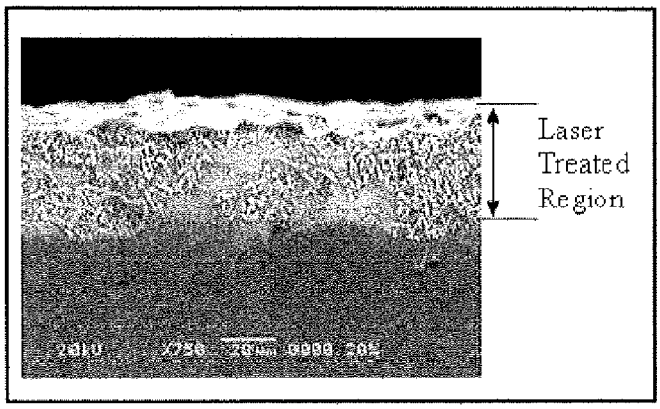
FIG. 3B is a scanning electron microscope micrograph image showing a cross-sectional view of the laser-treated Ti-6Al-4V surface of FIG. 3A.

FIG. 3A is a scanning electron microscope (SEM) micrograph image of the surface of a Ti-6Al-4V plate treated according to the method of FIG. 1. FIG. 3B is a cross-sectional view of the plate of FIG. 3A, illustrating the laser-treated region at the surface.

It should be understood that sprayer S in FIG. 2F is shown for illustrative purposes only, as is the stream of nitrogen $N_2$ coaxially surrounding laser beam B. Such nitrogen application for the nitriding of surfaces is well known in the art, and any suitable method for spraying or otherwise applying the nitrogen gas coaxially and simultaneously with laser beam 13 may be utilized. One such application of nitrogen gas to an alloy surface during nitriding is described in U.S. Pat. No. 4,588,450, which is hereby incorporated by reference in its entirety.

During the laser-irradiated heating of the surface of the plate P, the nitrogen diffuses into the material, starting at the surface and working inwardly, particularly via the grain and subgrain boundary regions and the dislocation lines. The nitrogen then combines with the constituents of the alloy to form complex nitrides. The nitride buildup (extending from the surface inwardly to a depth of approximately 15 μm) restricts the high diffusion paths and slows down the initial rate of oxidation diffusion of titanium or of any other material in the alloy that would normally be oxidized. The nitriding further increases resistance against both creep and fatigue.

Figure 3C:
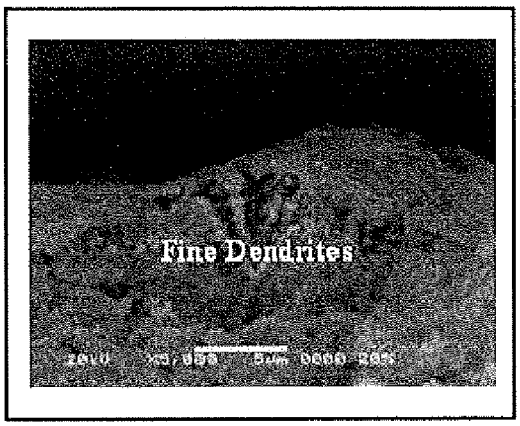
FIG. 3C is another scanning electron microscope micrograph image showing a cross-sectional view of the laser-treated Ti-6Al-4V surface of FIG. 3A, particularly illustrating very fine dendrite spacing therein.

FIG. 3C is an SEM micrograph image of the plate of FIGS. 3A and 313, particularly illustrating a very fine dendrite spacing in the treated surface. It can be observed that the laser scanning tracks appear as continuous melting sites due to the high overlapping ratio of the irradiated spot at the surface. The compact and dense layer is formed in the surface region of the treated layer. This results in a few scattered micro-sized voids in the surface vicinity of the treated layer. $TiC_xN_{1-x}$, $TiN_x$, Ti—C, and $Ti_2N$ compounds are formed in the surface region, which contributes to the enhancement of the surface hardness of the treated layer. However, non-uniform formation of the nitride-reach compounds in the surface's vicinity alters the micro-hardness at the treated surface. It should be understood that the above method may be utilized in the surface treatment of any suitable type of titanium alloy and is not limited to Ti-6Al-4V alone.

It is to be understood that the present invention is not limited to the embodiments described above, but encompasses any and all embodiments within the scope of the following claims.

We claim:

1. A method of laser treating Ti-6Al-4V to form surface compounds, comprising the steps of:

cleaning a Ti-6Al-4V workpiece;

applying a water-soluble phenolic resin to at least one surface of the Ti-6Al-4V workpiece;

heating the Ti-6Al-4V workpiece to carbonize the water soluble phenolic resin in order to form a carbon film on the at least one surface;

inserting TiC particles into the carbon film;

scanning a laser beam over the at least one surface of the Ti-6Al-4V workpiece; and spraying a stream of nitrogen gas on the surface of the Ti-6Al-4V workpiece coaxially and simultaneously with the laser beam to form a barrier layer thereon.

2. The method of laser treating Ti-6Al-4V to form surface compounds as recited in claim 1, wherein said step of cleaning the Ti-6Al-4V workpiece comprises applying a chemical cleaning bath to the Ti-6Al-4V workpiece.

3. The method of laser treating Ti-6Al-4V to form surface compounds as recited in claim 1, wherein the step of heating the Ti-6Al-4V workpiece to carbonize the water soluble phenolic resin to form the carbon film on the at least one surface further includes the step of maintaining an ambient pressure of argon at approximately 8 bars.

4. The method of laser treating Ti-6Al-4V to form surface compounds as recited in claim 3, wherein the step of heating the Ti-6Al-4V workpiece to carbonize the water soluble phenolic resin to form the carbon film on the at least one surface further includes heating at a temperature of approximately 175° C.

5. The method of laser treating Ti-6Al-4V to form surface compounds as recited in claim 4, wherein the step of heating the Ti-6Al-4V workpiece to carbonize the water soluble phenolic resin to form the carbon film on the at least one surface further includes heating for a period of approximately two hours.

6. The method of laser treating Ti-6Al-4V to form surface compounds as recited in claim 4, wherein the step of heating the Ti-6Al-4V workpiece to carbonize the water soluble phenolic resin further includes the step of heating of the Ti-6Al-4V workpiece until the density thereof is approximately 1.44 $g/cm^3$.

7. The method of laser treating Ti-6Al-4V to form surface compounds as recited in claim 1, wherein the step of inserting TiC particles into the carbon film further comprises inserting TiC particles having an average particle size of approximately 6 μm.

8. The method of laser treating Ti-6Al-4V to form surface compounds as recited in claim 7, wherein the step of inserting TiC particles into the carbon film further comprises inserting TiC particles so that a volume fraction of the TiC particles inserted into the carbon film is approximately 20%.

9. The method of laser treating Ti-6Al-4V to form surface compounds as recited in claim 1, wherein the step of scanning the laser beam over the surface of the Ti-6Al-4V workpiece comprises scanning the laser beam at a rate of approximately 10 cm/sec.

10. The method of laser treating Ti-6Al-4V to form surface compounds as recited in claim 9, further comprising the step of generating the laser beam with a carbon dioxide laser.

11. The method of laser treating Ti-6Al-4V to form surface compounds as recited in claim 10, wherein said step of generating the laser beam with the carbon dioxide laser comprises generating the laser beam with a power intensity of approximately 110 $W/m^2$.

12. The method of laser treating Ti-6Al-4V to form surface compounds as recited in claim 11, wherein said step of spraying the stream of nitrogen gas on the surface of the Ti-6Al-4V workpiece coaxially and simultaneously with the laser beam comprises spraying pressurized nitrogen gas having a pressure of approximately 600 kPa.

13. A method of laser treating Ti-6Al-4V to form surface compounds, comprising the steps of:

applying a chemical cleaning bath to a Ti-6Al-4V workpiece;

ultrasonically cleaning the Ti-6Al-4V workpiece;

applying a water-soluble phenolic resin to at least one surface of the Ti-6Al-4V workpiece;

heating the Ti-6Al-4V workpiece to carbonize the water soluble phenolic resin in order to form a carbon film on the at least one surface;

inserting TiC particles into the carbon film;

scanning a laser beam over the at least one surface of the Ti-6Al-4V workpiece; and spraying a stream of nitrogen gas on the surface of the Ti-6Al-4V workpiece coaxially and simultaneously with the laser beam to form a barrier layer thereon.

14. The method of laser treating Ti-6Al-4V to form surface compounds as recited in claim 13, wherein the step of heating the Ti-6Al-4V workpiece to carbonize the water soluble phenolic resin to form the carbon film on the at least one surface further includes the step of maintaining an ambient pressure of argon at approximately 8 bars.

15. The method of laser treating Ti-6Al-4V to form surface compounds as recited in claim 14, wherein the step of heating the Ti-6Al-4V workpiece to carbonize the water soluble phenolic resin to form the carbon film on the at least one surface further comprises heating the workpiece at a temperature of approximately 175° C.

16. The method of laser treating Ti-6Al-4V to form surface compounds as recited in claim 15, wherein the step of heating the Ti-6Al-4V workpiece to carbonize the water soluble phenolic resin to form the carbon film on the at least one surface further comprises heating the workpiece for a period of approximately two hours.

17. The method of laser treating Ti-6Al-4V to form surface compounds as recited in claim 15, wherein the step of heating the Ti-6Al-4V workpiece to carbonize the water soluble phenolic resin to form the carbon film on the at least one surface further includes the step of heating the Ti-6Al-4V workpiece until the density thereof is approximately 1.44 $g/cm^3$.

18. The method of laser treating Ti-6Al-4V to form surface compounds as recited in claim 13, wherein the step of inserting TiC particles into the carbon film further comprises inserting TiC particles having an average particle size of approximately 6 μm.

19. The method of laser treating Ti-6Al-4V to form surface compounds as recited in claim 18, wherein the step of inserting TiC particles into the carbon film further comprises inserting the TiC particles so that a volume fraction of the TiC particles inserted into the carbon film is approximately 20%.

* * * * *